United States Patent [19]

Shaw et al.

[11] Patent Number: 5,042,683

[45] Date of Patent: Aug. 27, 1991

[54] CONTAINMENT STORAGE APPARATUS

[76] Inventors: Mark D. Shaw, 5469 Running Creek La.; J. Tad Heyman, 11858 Olde Oaks CT N., both of Jacksonville, Fla. 32223; Laurence M. Bierce, 2269 Villanova Cir., Jacksonville, Fla. 32218

[21] Appl. No.: 529,109

[22] Filed: May 25, 1990

[51] Int. Cl.[5] ..... B65D 43/20

[52] U.S. Cl. ..... 220/408; 220/346; 220/4.21; 220/602; 220/345; 206/524.6

[58] Field of Search ..... 220/408, 410, 411, 412, 220/346, 351, 4 B, 82 R, 306, 345; 206/524.6

[56] References Cited

U.S. PATENT DOCUMENTS

| | | | |
|---|---|---|---|
| 301,753 | 7/1884 | Porter et al. | 220/408 |
| 646,283 | 3/1900 | Heatly et al. | 220/4 B |
| 2,245,798 | 6/1941 | May | 220/345 |
| 2,501,894 | 3/1950 | Eide | 220/346 |
| 2,712,880 | 7/1955 | Moore | 220/4 B |
| 3,278,009 | 10/1966 | Crump | 220/345 |
| 4,057,166 | 11/1977 | Yamazaki et al. | 220/345 |
| 4,361,232 | 11/1982 | Olmsted | 206/524.6 |
| 4,363,240 | 12/1982 | Mizusaki | 220/82 R |
| 4,469,241 | 9/1984 | Westphal | 220/346 |
| 4,502,610 | 3/1985 | Todd | 220/346 |
| 4,753,351 | 6/1988 | Guillin | 220/82 R |
| 4,757,920 | 7/1988 | Harootian et al. | 220/4 B |
| 4,815,591 | 3/1989 | Tivy | 220/1 C |

FOREIGN PATENT DOCUMENTS

| | | | |
|---|---|---|---|
| 2010718 | 9/1971 | Fed. Rep. of Germany | 220/345 |
| 508855 | 7/1939 | United Kingdom | 220/345 |

*Primary Examiner*—Stephen Marcus
*Assistant Examiner*—S. Castellano
*Attorney, Agent, or Firm*—Thomas C. Saitta

[57] ABSTRACT

A secondary containment apparatus for use in combination with primary containers for hazardous wastes such as drums or large barrels, comprising a generally rectangular base member and two generally rectangular lid members of a size sufficient to enclose one or more primary containers. The lid members are moveable only laterally in relation to the base member, the lateral movement allowing access to the drums contained within. The lid members have interlocking means to form a releasable closure, and have engagement means for attachment to the base member. The base member is impermeable to liquids, and is preferably composed of translucent plastic for visual inspection.

12 Claims, 2 Drawing Sheets

CONTAINMENT STORAGE APPARATUS

BACKGROUND OF THE INVENTION

This invention relates generally to the field of secondary containment storage systems used to store primary containers containing hazardous wastes. More particularly the invention relates to a transportable apparatus able to completely enclose hazardous materials in a structure which prevents accidental spillage or loss of the hazardous waste in the case of damage to the primary containers.

Our modern society produces waste materials which can harm the environment if not stored, transported or disposed of in a safe manner. Numerous regulations by various governmental agencies set forth requirements which must be adhered to in the handling of such hazardous materials. Even a small volume generator of hazardous materials must follow guidelines for handling such materials safely. The danger of harm is so significant that numerous regulations are directed toward secondary containment units which will entrap any spillage or loss from the primary storage containers, such as large drums, before the hazardous waste can pollute the outside environment.

Such secondary containment units are generally known in the art. For example, Olmsted in U.S. Pat. No. 4,361,232 teaches a protective container for use with large drums. The container comprises a solid, rectangular pan with side walls and a removable lid to fit over the pan. The device is constructed so as to rest on a typical wooden pallet and is designed to contain a number of large drums filled with hazardous liquid waste. The lid has side walls which overlap the walls of the pan when the lid is resting on the drums. The device is very simple in nature, and it is this simplicity which creates problems and inadequacies. The device requires that the lid be completely removed for access to the individual drums, which is not desirable for situations where the drums are being filled in small increments over a period of time, as in practice the user tends to fail to replace the lid after each use. Additionally, the device requires a secondary component, the conventional pallet, for transport of the unit. The device of Olmsted also requires a liquid level sensor to create an alarm should there be a loss of liquid from the primary storage units. Additionally, the seal between lid and pan is not secure against overflow or environmental forces, requiring a gasket to increase containment capability.

It is an object of the invention to provide a secondary containment storage apparatus capable of enclosing one or more large drums containing hazardous waste materials, where the apparatus will retain without loss hazardous waste stored in the drums, should leakage occur.

It is a further object to provide such an apparatus having a sliding, interlocking lid such that removal of the lid from the main base member is not required for access to the drums, yet the two lid sections when closed will prevent ingress of rain, snow, etc. into the unit.

It is a further object to provide such an apparatus where the seal between lid and main body prevents ingress of rain, snow, etc., and is capable of withstanding relatively large load forces without separation.

It is a further object to provide such an apparatus where the base member is designed to allow movement of the unit by conventional forklifts or pallet jacks.

It is a further object to provide such an apparatus with translucent side walls for visual indication of fluid level.

It is a further object to provide such an apparatus where the base members of plural units are nestable for storage and transport, with the lid sections fitting in the interior of the base members.

BRIEF SUMMARY OF THE INVENTION

The invention is a secondary containment apparatus for use in combination with primary waste containers, such as large drums or barrels. The apparatus comprises a base member and two lid members which combine to create a closed container around one or more drums. The overall configuration of the unit is rectangular. The base member comprises a bottom, side walls and end walls, with an open top. Preferably the walls and ends are angled slightly outward. The lid members each comprise a top, end wall and side walls, with the side walls and end walls also angling slightly outward. The lid members have engagement means to attach the lid members to the base member, such that the lid members may slide laterally in relation to the base member. The lid members further comprise interlocking means to form a retaining seal when the lid members are connected. When the lid members are engaged on the base member and interlocked with each other, the unit completely encloses the primary storage drums in a closed system.

The base member preferably comprises a rail member which provides a track for the lateral movement of the lid members. The engagement means of the lid members attach to this rail member. The interlocking means of the lid members is preferably comprised of interfitting lips which easily snap closed and release. Leg members are attached to the bottom of the base member to allow use of a forklift or pallet jack to move the unit. The apparatus is preferably constructed of a translucent plastic material.

DETAILED DESCRIPTION OF THE INVENTION

The invention will be described, with the accompanying drawings, in the structural configuration for containment of two large drums. It is to be understood that the invention also encompasses structural configurations sized for containment of any number of drums, including the circumstance of a single drum. Such configurations will differ only in overall dimensions, the elements and components of the invention remaining the same.

Figure 1:
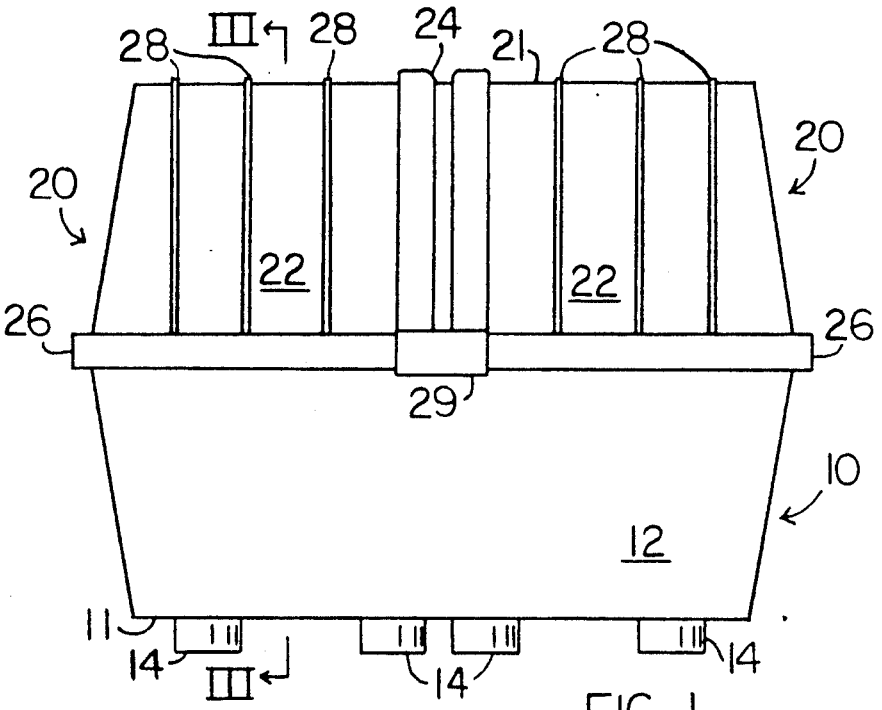
FIG. 1 is side view of the invention.
Figure 2:
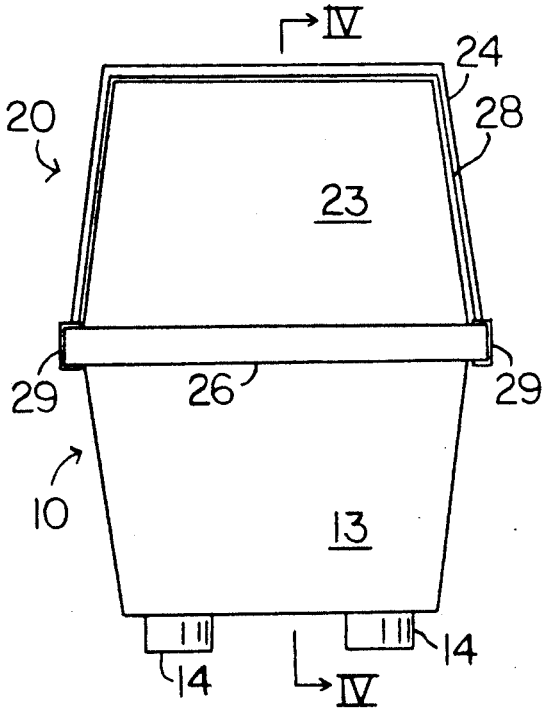
FIG. 2 is an end view of the invention.

With reference to FIGS. 1 and 2, the overall configuration of the invention is shown. The apparatus comprises a base member 10 and two lid members 20. The general shape of the apparatus is a rectangular container. Base member 10 comprises a bottom 11, two side walls 12 and two end walls 13. Bottom 11 is substantially rectangular with side walls 12 and end walls 13 substantially upright. Bottom 11 is relatively planar to support the drums, but may be constructed with ridges or other raised areas. Furthermore, a drain may be incorporated in bottom 11, which can also be sloped, to facilitate drainage. It is preferable that side walls 12 and end walls 13 angle slightly outward, such that the open top of base member 10 is larger than bottom 11. This allows plural base members 10 to be nested one inside the next for purposes of storage and transportation. Extending below bottom 11 are a number of legs 14 to support the base member 10 above the floor surface. Legs 14 are of sufficient height and separation to allow room for insertion of the arms of a forklift or pallet jack for transport of the unit. Preferably, legs 14 are circular to deflect the forklift arms without damage should the operator strike one of the legs 14 by mistake. For mobility on level surfaces, casters or wheels may be attached beneath base member 10.

Figure 3:
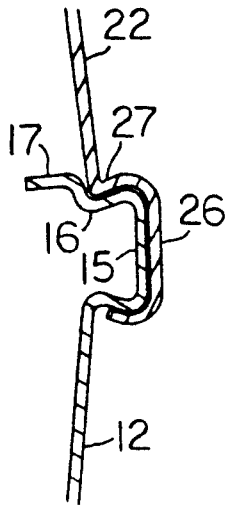
FIG. 3 is a portion of a cross-section taken along line III—III of FIG. 1, showing the engagement of the base rail member and the lid runner member.

Around the upper perimeter of the base member 10, preferably on both side walls 12 and end walls 13, but at least on the two side walls 12, rail member 15 extends outward for engagement of the lid members 20, as shown in FIG. 3. Rail member 15 is a generally C-shaped guide providing the means for retaining the lid members 20 on the unit and at the sam time allowing the lid members 20 to be separated from each other by sliding each lid member 20 along the trough 16 formed on the upper surface of rail member 15. The configuration of trough 16 is concave or bevelled such that its interior portion is lower than its exterior to form an inward slant. Thus, trough 16 keeps the lid members 20 securely sealed and in place on base member 10, even under large load forces, since the downward pressure will force the runner members 27 of the lid engagement members 26 firmly into trough 16 rather than outward. Additionally, the upper edge of side walls 12 and end walls 13 may have a deflector rim 17, which is a small flange angled downward toward the interior of the base member 10. This deflector rim 17 acts to direct any liquid striking its surface into the interior of the unit rather than out into the environment.

Figure 5:
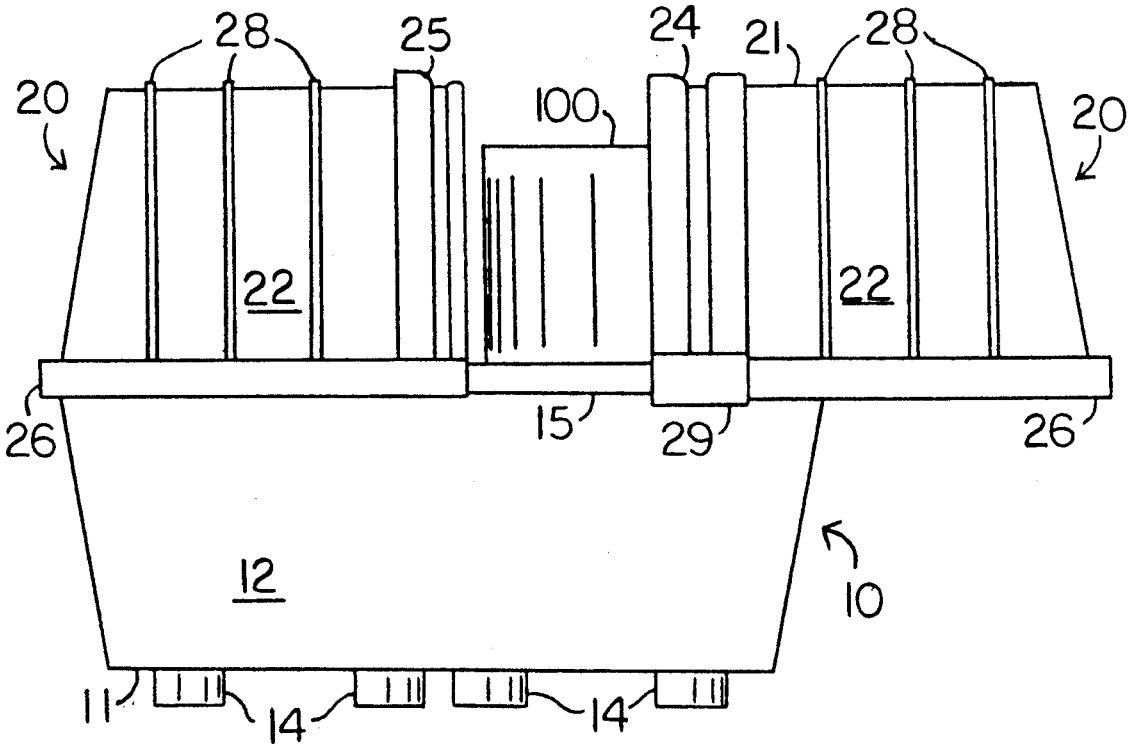
FIG. 5 is a side view showing one lid section in the open position to allow access to one of the drums.

Each lid member 20 comprises a top 21, side walls 22 and an end wall 23. As with the base member 10, the end wall 23 and side walls 22 are preferably angled outward so that the open bottom is larger than the top 21. This allows nesting of a number of the lid members 20 within themselves or within the base members 10 for transport and storage. For additional structural strength, ribs 28 or other formations may be incorporated in the lid members 20 or in the base member 10. For connecting the lid members 20 to the base member 10, engagement means are comprising engagement member 26 are provided. Lid engagement member 26 is positioned around the bottoms of side walls 22, and preferably end wall 23, of both lid members 20. Lid engagement member 26 is substantially C-shaped to correspond to and enclose rail member 15 of the base member 10. The joint of the engagement member 26 to the side walls 22 and end wall 23 is configured to correspond to the trough 16 of the base member 10, so that a runner member 27 is formed. Runner member 27 will be convex or angled to seat within trough 16. Any downward pressure will force runner member 27 into trough 16, maintaining the lid members 20 on base member 10. Runner member 27 will slide laterally within trough 16, so that the lid members 20 can be moved transversely along rail member 15 to expose a drum 100, as shown in FIG. 5. Thus the lid member 20 does not need to be completely removed to allow access to the drum 100, such as when it is needed to pour liquid into said drum 100. The C-shape of engagement members 26 acts to clamp the lid members 20 onto rail member 15, such that the lid members cannot be removed from the base member 10 in the vertical direction. Furthermore, in the preferred embodiment where the rail member 15 and engagement members 16 extend around the end walls 13 and 23, respectively, the curvature of engagement members 26 will lock the lid members 20 in place on base member 10 when the lid members 20 are fully closed, by snapping around rail member 15 on the end walls 13.

Figure 4:
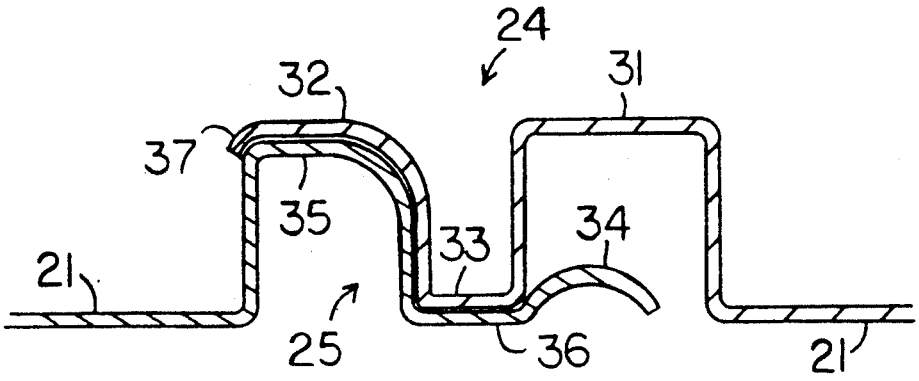
FIG. 4 is a portion of a cross-section taken along line IV—IV of FIG. 2, showing the interlocking configuration of the two lid sections.

It is necessary that the two lid members 20 form a secure seal with each other when in the fully closed position to preclude rain, snow, etc. from entering the unit. This is accomplished by providing interlocking means, such as by configuring the open ends of the top 21 and side walls 23 to form an overlapping or mating joint. As shown in FIG. 4, one lid member 20 is formed with an external lip 24 and the other lid member is formed with an internal lip 25, such that the internal lip 25 will interlock with the external lip 24 to form a secure seal to retain the two lid members 20 in a closed position. The shape of the internal lip 25 an the external lip 24 allow the lid members 20 to be easily opened and closed. In the preferred embodiment, exterior lip 24 is comprised of a full ridge 31, an open ridge 32 and a mid-plateau 33. Internal lip 25 is comprised of a full ridge 35, a latching ridge 34 and a mid-plateau 36. Open ridge 32 of the external lip 24 preferably has a small snap flange 37. To perform the closure operation, the lid members 20 are pushed together such that the internal lip 25 slides inside external lip 24. Latching ridge 34 flexes below mid-plateau 33 and abuts internally within full ridge 31. Full ridge 35 seats within open ridge 32, with snap flange 37 abutting the down side of full ridge 35. In this manner the two lid members 20 are securely held together by the interlocking means, yet are easily separable by sufficient pulling force. The snap flange 37 and mid-plateau 36 prevent any liquids or debris from entering the unit when the lid members 20 are closed. The end portions of engagement member 26 on the lid member 20 having external lip 24 are enlarged to form sleeves 29. This allows the engagement member 26 of the lid member 20 having the internal lip 25 to fit within sleeve 29 when the two lid members 20 are fully closed. Apertures to receive locks may be aligned in the sleeve 29, engagement member 26 and rail member 15 for security purposes. It is also seen that the design of the lid members 20 allows them to be completely removed from the base member 10 by fully sliding them laterally off of rail member 15 if required.

It is preferable that the invention be constructed of a plastic material such as polyethylene, due to its superior structural and chemical resistance properties, but the apparatus may be constructed of any suitable material having the necessary properties of liquid impermeability. Construction with a plastic material allows the unit to be formed having a translucent base member 10. This allows easy visual determination of any fluid accumulation inside the unit. While the unit as shown is substantially rectangular, a relatively square configuration is possible for use with one or four drums. The overall minimum size of the apparatus is a function of the number of drums to be contained within. Regulations usually require that the volume of the base member 10 be either at least 10 percent of the total capacity of all the drums contained within the unit or 10 percent greater than the largest single drum in the group, whichever amount is greater. For example, if a 55 gallon drum is the largest container size in the unit, then the base member 10 must have a volume greater than 60.5 gallons (55+5.5 gallons).

The above examples were given for purposes of illustration, and it will be apparent to those skilled in the art that obvious substitutions and equivalents may be possible. The full scope and definition of the invention therefor is to be as set forth in the following claims.

We claim:

1. A secondary containment apparatus used in combination with one or more primary storage drums, comprising:

(A) a generally rectangular base member having a bottom, end walls and side walls defining a space to receive said storage drums, said base member having a generally C-shaped rail member and said base member being impermeable to liquids;

(B) two generally rectangular lid members each having a top, side walls and an end wall, said lid members having interlocking means to releasably interlock said lid members to each other, said interlocking means comprising an internal lip on one of said lid members and an external lip on the other of said lid members, where said internal lip fits within said external lip to form a retaining seal when said lid members are interlocked; said internal lip comprising a large ridge, a plateau portion and a smaller latching ridge, and said external lip comprising a large ridge, a plateau portion and an open ridge; said lid members further having generally C-shaped engagement means enclosing said rail member to slidingly engage said lid members with said base member, whereby said lid members, when engaged with said base member and when interlocked with each other, define a closed space to completely enclose said storage drums.

2. The apparatus of claim 1, further comprising legs attached below said base member.

3. The apparatus of claim 1, where said end walls and said side walls of said base member angle outward from said bottom, and said end wall and said side walls of each of said lid members angle outward from said top.

4. The apparatus of claim 1, where said lid members are completely removable from said base member.

5. The apparatus of claim 1, where said base member is constructed of a translucent plastic material.

6. The apparatus of claim 1, further comprising a rim extending internally from the tops of said side walls and said end walls of said base member.

7. A secondary containment apparatus used in combination with one or more primary storage drums, comprising:

(A) a generally rectangular base member having a bottom, end walls and side walls defining a space to receive said storage drums, said base member being impermeable to liquids;

(B) two generally rectangular lid members each having a top, side walls and an end wall, said lid members having interlocking means to releasably interlock said lid members to each other, said interlocking means comprising an internal lip on one of said lid members and an external lip on the other of said lid members, where said internal lip fits within said external lip to form a retaining seal when said lid members are interlocked, said internal lip comprising a large ridge, a plateau portion and a smaller latching ridge, and said external lip comprising a large ridge, a plateau portion and an open ridge; said lid members further having engagement means to slidingly engage said lid members with said base member, whereby said lid members, when engaged with said base member and when interlocked with each other, define a closed space to completely enclose said storage drums.

8. The apparatus of claim 7, further comprising legs attached below said base member.

9. The apparatus of claim 7, where said end walls and said side walls of said base member angle outward from said bottom, and said end wall and said side walls of each of said lid members angle outward from said top.

10. The apparatus of claim 7, where said lid members are completely removable from said base member.

11. The apparatus of claim 7, where said base member is constructed of a translucent plastic material.

12. The apparatus of claim 7, further comprising a rim extending internally from the tops of said side walls and said end walls of said base member.

* * * * *